United States Patent [19]

Keck

[11] 3,940,042

[45] Feb. 24, 1976

[54] SPEED CONTROL DEVICE

[76] Inventor: Norman A. Keck, 707 4th Ave., Joliet, Ill. 60433

[22] Filed: Oct. 24, 1974

[21] Appl. No.: 517,795

[52] U.S. Cl. ..... 226/44; 226/45; 226/111; 226/118; 338/158

[51] Int. Cl.[2] ..... B65H 25/04

[58] Field of Search ..... 226/44, 45, 111, 113, 117, 226/118, 30, 42; 340/259; 200/61.13, 61.16, 61.52, 61.48–61.51; 338/157, 158

[56] References Cited

UNITED STATES PATENTS

| | | | |
|---|---|---|---|
| 1,988,192 | 1/1935 | Drabin | 338/157 X |
| 3,629,748 | 12/1971 | Collier | 200/61.52 X |
| 3,870,215 | 3/1975 | Schiffer | 226/44 X |

*Primary Examiner*—Allen N. Knowles
*Attorney, Agent, or Firm*—Carl C. Batz

[57] ABSTRACT

A device for equalizing the speeds at which material moves through different sections of a machine which includes a tiltable structure sensitive to the depth of sag of the material passing from one section to another, a coil having a straight longitudinal axis is attached to the tiltable structure, and a spaced strip is disposed alongside the coil to provide a straight raceway containing a conductive ball, whereby tilting of the structure may allow gravity to move the ball along the raceway and so vary the impedance between the ball and one end of the coil. Another feature involves having multiple balls in the raceway, preferably of different diameter.

7 Claims, 4 Drawing Figures

Fig. 1
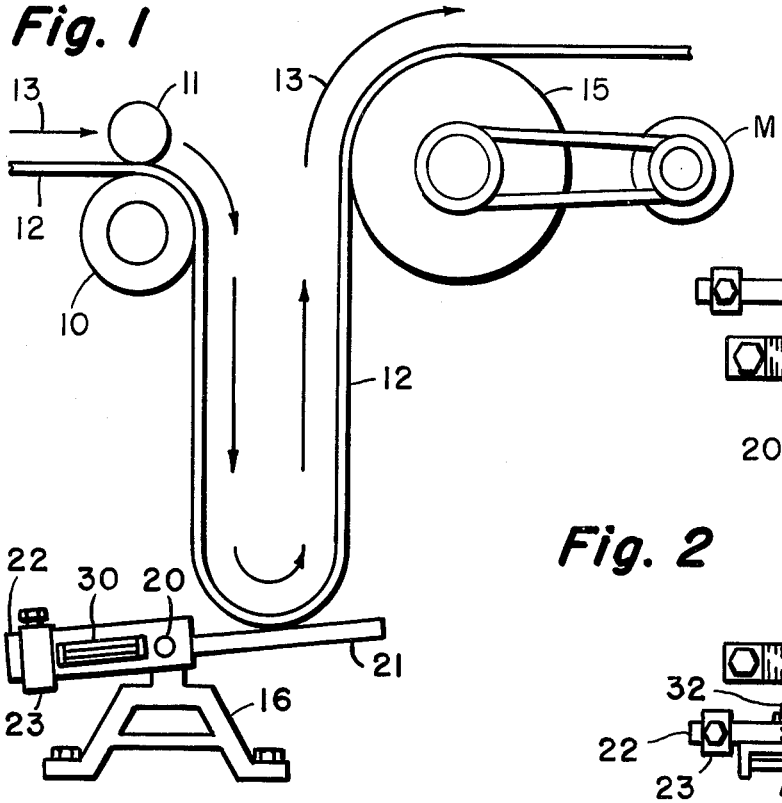
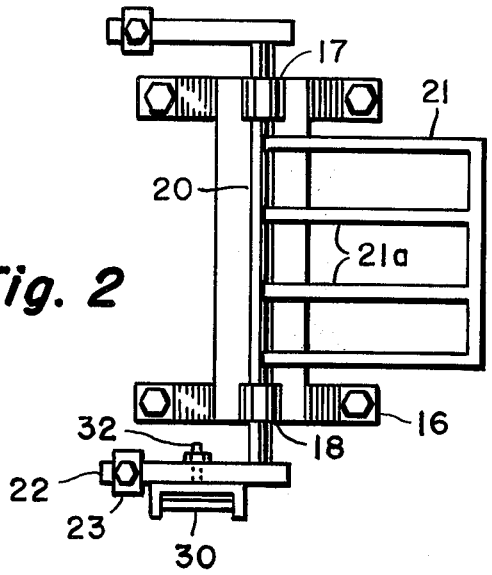
Fig. 2
Fig. 3
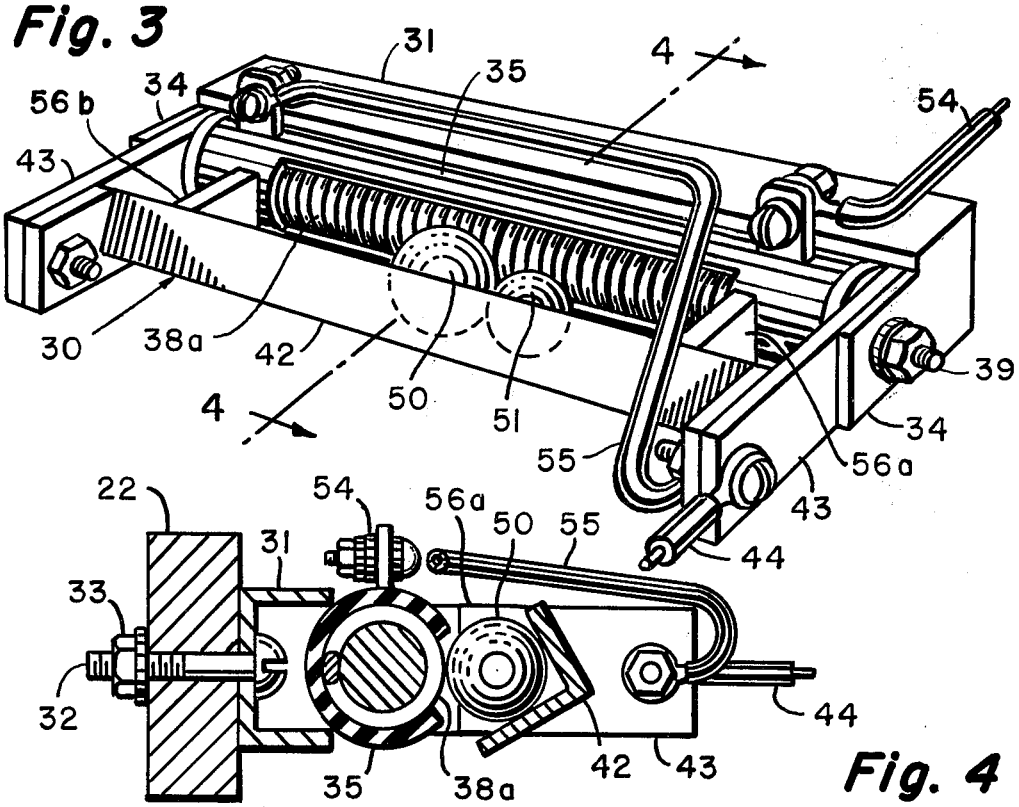
Fig. 4

SPEED CONTROL DEVICE

This application relates to a device for regulating the speed of material being passed through one section of a machine in accordance with the speed of this material in another section of the machine and more particularly to such a device which is sensitive to the depth of the loop formed by the material as it passes from section to section.

BACKGROUND

There are many situations in industry where a flexible sheet material such as paper, cloth, or the like, is passed through different sections of machinery and where the speed at which such material is passed through one of such sections may vary from the speed at which it is passed through another section. It would be highly desirable in such situations to regulate the speed at which the material is passed through the other section to correspond with the speed at which it is passed through the one section so that the material does not either pile up or come into undue tension between sections.

In speaking of "machine," I include the separate mechanisms through which the material is passed continuously, however separated those mechanisms may be.

I am aware of attempts which have been made in the past to solve this problem of variable speed by the provision of devices having levers which contact the loops of material between sections using rheostats to arrange to be operated by the levers thus to cause the speed of the driving motor to be increased so as to take up the additional slack when the speed of the material in a previous section is increased. However, an object to such an arrangement is that the friction involved in operating the rheostat is too great to be operated by anything which is only in lightly touching contact with the moving loop of material between the sections. Another object is that the mechanisms needed for the actuation of such rheostats become mechanically complex and cumbersome, requiring special constructions and the use of nonstandard electrical parts.

It is therefore an object of this invention to provide a device for coordinating the speed of a material through a section of a machine with the speed at which the material is being passed through another section of the machine and to accomplish this smoothly in an effective way without the use of complicated or complex mechanisms. A further object is to provide such a device which will sense the depression of the material between sections with a light touch and which at the same time will positively operate to change the speed of the driving motor for one section so as to coordinate it with the speed of the material being passed through the other section. Still another object is to provide such a device which will accomplish the purpose in a smooth manner and in such a way that only small variations in speed will bring on a necessary adjustment. Other objects and advantages of the invention will be apparent as the specification proceeds.

In my copending application, Ser. No. 455,643 filed Mar. 28, 1974, I describe a device of the character above referred to which includes an annular coil of wire having electrical impedance and mounted on a tiltable structure, and an annular raceway beside the coil with a ball which stays at the lowest point in the raceway and so produces variation in the impedance of the coil between the ball and an end of the coil as the structure is tilted.

SUMMARY OF THE INVENTION

In the present invention I provide a device which includes a coil which is wound about a straight axis, the coil being mounted on a tiltable structure in such a way that the axis of the coil is transverse with the axis about which this structure is tilted. I find that such a device is very effective to quickly equalize the speeds of different sections of a machine.

DETAILED DESCRIPTION

One embodiment of my invention is illustrated in the accompanying drawings in which:

FIG. 1 is a schematic illustration of one type of machine in which coordination of speeds is needed and showing my improved device in a side elevational view;

FIG. 2 is a top view of the device illustrated in FIG. 1;

FIG. 3 is a perspective view of the impedance element and conductor strip which together provide a raceway for the ball; and FIG. 4 is a sectional view of the impedance element and the raceway, the section being taken as seen from line 4—4 of FIG. 3.

As illustrated in FIG. 1, there is shown a section 1 of a machine which includes rolls 10 and 11 between which a flexible sheet 12 is passed in the direction of arrows 13. After passing from section 1 the flexible material falls downwardly to form a loop 14, the other side of which passes upwardly and into section 2 of the machine. A motor M drives roll 15 to pass the material onwardly in section 2.

The device for coordinating the speeds of the material in the different sections includes the base 16 on which are mounted bearings 17 and 18 which contain the substantially horizontal shaft 20. Secured to shaft 20 is a member 21 which includes one or more finger pieces 21*a* extending transversely of the shaft. This member is arranged to contact the lowermost points of the loop so that when moved up and down to contact with the lower part of the loop member 21 this serves to turn shaft 20 clockwise (as seen in FIG. 2) when the loop is deepened, and to turn the shaft counterclockwise as the bottom of the loop raises.

To counterbalance the weight of the member 21 and to press this member into very light contact with the bottom of the loop 14, I provide the counterbalancing arm 22 which is secured to shaft 20 and extends transversely from shaft 20 in a direction opposite to that of member 21. A weight 23 is mounted on arm 22 and is adjustable along the length of the arm as may be necessary to give the slight upward pressure by the member 21 against the bottom of the loop.

Mounted on arm 22 is the coil and raceway device 30 which is illustrated in detail of FIGS. 3 and 4 but which is shown generally in FIGS. 1 and 2 as being mounted on the arm 22. It may be seen that the longitudinal axis of the coil is transverse with the shaft 20 which is the axis about which the members 21 and 22 are tilted. By the term "transverse" I do not mean that it necessarily makes an angle of 90° with the shaft but that it extends generally in a transverse direction.

Referring now more particularly to FIGS. 3 and 4, the device 30 includes a bracket 31 which at its longitudinal center has an aperture through which bolt 32 extends. Bolt 32 passes also through an aperture in the arm 22 and is engaged by a nut 33 on the other side of the arm. This construction allows the device 30 to be adjustable to tilt it with respect to arm 22 merely by loosening bolt 33. The function of such adjustment will be explained hereinafter.

The bracket 31 has end pieces 34 between which the coil element 35 is mounted.

Coil element 35 has a cylindrical core 36 (FIG. 4). Concentric with the core is the wire coil 37 and over this is the insulating covering 38. Covering 38 has a window 38*a* therein through which the bare wire of coil 37 may be contacted.

Coil element 35 is mounted in bracket 31 between bracket ends 34 by means of the bolts 39. The coil has connectors 40 and 41 which make electrical connection with the ends of the coil.

On the front side of coil 37 is an angle piece 42 which parallels the longitudinal dimension of the coil. Angle piece 42 has its ends fastened to bracket extensions 43 which in turn are fastened to the ends of bracket 31.

Angle piece 42 is spaced from the coil and in register with the window in the coil insulation so that there is provided between the coil and this piece a raceway for the balls 50 and 51. Balls 50 and 51 are made of steel or other electrical conducting material and are movable in the raceway longitudinally of the coil. An electrical circuit is made from either end of the coil to the point where a ball contacts the coil, thence through the ball and the angle piece 42 to the connecting wire 44.

As shown, the wire 54 is connected to one end of the coil 35, and a wire 55 connects the other end of the coil to the wire 44. If there should be any failure to make electrical connection through either of balls 50 and 51 the electrical circuit between wires 54 and 44 is not broken, but in such an event this circuit includes the whole of the coil 35.

It is essential to use only the ball 50 but I prefer to use two balls 50 and 51 one of which is somewhat larger than the other so that there is contact at different levels along the coil and greater insurance that contact will always be made between the coil and the angle piece. There are also other advantages to the use of multiple balls as will later be explained.

The electrical circuit through element 30 is from the connecting wire 54, which may be connected to one of connectors 40 or 41, through the nearest ball to this connector which is making contact with coil 37, and through angle piece 42 to connecting wire 44. While direct current may be used in which case only the resistance between the ball and the end of the coil connected to wire 54 is utilized, I may also use an alternating current system in which the inductance of the part of the coil which is in the circuit is utilized in the control being effected. In this disclosure I use the term "impedance" to represent either a resistance, an inductance, or both.

OPERATION

Referring to FIG. 1, when the material 12 speeds up between rolls 10 and 11 or lags in passing over roll 15 so that the loop 14 deepens, the tiltable structure 21 and 22 tilts in a clockwise direction about the axis of shaft 20. Since the element 30 is attached to arm 20 it likewise tilts so that balls 50 and 51 roll in their raceway toward the lead 44 thus reducing the impedance between leads 54 and 44. The wires 54 and 44 may be connected to the circuit of motor M so that such reduction in impedance results in an increase in motor speed. Likewise if motor M tends to drive the second section faster than the first section, this will cause element 30 to be tilted in the opposite direction thus producing a correction in speeds in the opposite way. In either case the balls actually move in one or another linear direction as they roll along the inclined raceway.

It might be supposed that the momentum of the balls would produce a greater unbalance by overcorrecting, and indeed some overcorrection may take place, but I have found that the unbalance is quickly overcome and a sensitive balance comes to be maintained. Though the initial distance which the balls travel in the raceway may be relatively large, the system quickly comes into balance. For preventing the balls from moving endwise beyond the coil, I provide the end blocking members 55 and 56.

I have further found that the effect when using multiple balls is preferred. It may be observed that it is the ball closest to the connected end of the coil which determines the amount of impedance in the circuit, and the second ball through frictional contact with the first helps to dampen the movement of the first ball, and vice versa.

When any oscillation of the balls has ceased, the element 30 will have come to be horizontal and level, so that gravity does not move the balls in either direction, and this condition continues until the material again begins to pass through one section of the machine faster than through the other section, and the corrective process then begins again.

To adjust my device to allow for a deeper or more shallow loop of the material between the sections of the machine, the operator may loosen nut 33, and tilt the element 30 about bolt 32. By tilting element 30 in one direction about the bolt, the member 21 is at a higher position when the element 30 comes into balance, and by tilting element 30 in the other angular direction, the member 21 is in a lower position when the element 30 comes into balance.

While I have illustrated only one embodiment of the invention and have described in detail this embodiment with some variations being mentioned, it should be understood that the structure of my invention may be varied in many ways and may be changed in many respects all within the spirit of the invention and within the scope of the appended claims.

I claim:

1. In a machine wherein a flexible material is passed at varying speeds through one section of the machine and also through another section of the machine with the machine having a device coordinating the speed of said material and each of said sections, the improvement in said device comprising a tiltable structure, means sensitive to the extent of the material's sag between said sections for tilting said structure, an impedance element in the form of a coil about a straight longitudinal axis, said longitudinal axis extending substantially horizontally and radially of the axis of tilt of said structure, a strip of electrically conductive material parallel and spaced from said coil, said strip forming with said coil a straight raceway for a ball, a ball of electrically conductive material in said raceway whereby when said raceway is horizontal said ball is stationary but when inclined downwardly in one or another direction said ball is moved by gravity in said direction, and means sensitive to the impedance between one end of said coil and said ball for changing the speed of said material through one of said sections to bring the speed of said material in said sections more nearly into equilibrium.

2. A machine as set forth in claim 1 in which said tiltable structure has an arm which extends transversely of the axis of the tilt of said structure, and in which said coil is mounted on said arm.

3. A machine as set forth in claim 2 in which said coil is adjustably mounted to allow tilting of the coil with respect to the arm.

4. A machine as set forth in claim 1 in which said coil has an outer insulation coating having a window therein through which said ball contacts the wires of said coil.

5. A machine as set forth in claim 1 which includes a second ball within said raceway and in which both of said balls are in electrical contact with said coil and with said strip, and in which an electrical circuit is provided leading from one end of said coil through the ball which is closest said end of the coil and through said strip.

6. A machine as set forth in claim 5 in which said balls are of different diameter.

7. In a machine wherein a flexible material is passed at varying speeds through one section of the machine and also through another section of the machine with the machine having a device coordinating the speed of said material in each of said sections, the improvement in said device comprising a tiltable structure, means sensitive to the extent of the material's sag between said sections for tilting said structure, an impedance element in the form of of a coil about a straight longitudinal axis, said longitudinal axis extending substantially horizontally and radially of the axis of tilt of said structure, a strip of electrically conductive material parallel to and spaced from said coil, said strip forming with said coil a straight raceway for a ball, a ball of electrically conductive material in said raceway whereby when said raceway is horizontal said ball is stationary but when inclined downwardly in one or another direction said ball is moved by gravity in said direction, and means sensitive to the impedance between one end of said coil and said ball for changing the speed of said material through one of said sections to bring the speed of said material in said sections more nearly into equilibrium, said tiltable structure having an arm which extends transversely of the axis of the tilt of said structure, said coil being mounted on said arm, and said sensitive means including a member extending in one direction which member contacts said material, and which includes a weight mounted on said arm and slideable therealong to provide a counterbalancing effect to said last mentioned member.

* * * * *